US006131953A

United States Patent [19]

Connell et al.

[11] Patent Number: 6,131,953

[45] Date of Patent: Oct. 17, 2000

[54] COILED TUBING DRILLING HYDRAULIC DISCONNECT

[75] Inventors: Michael L. Connell, Duncan; James C. Tucker, Springer; Brian K. Goodin, Duncan, all of Okla.

[73] Assignee: Halliburton Energy Services, Inc., Duncan, Okla.

[21] Appl. No.: 09/088,583

[22] Filed: Jun. 2, 1998

[51] Int. Cl.[7] ..... F16L 35/00

[52] U.S. Cl. ..... 285/3; 285/18; 285/83; 285/86; 285/330

[58] Field of Search ..... 166/377, 338, 166/340, 344; 285/1, 2, 330, 3, 4, 18, 83, 39, 86

[56] References Cited

U.S. PATENT DOCUMENTS

| | | | |
|---|---|---|---|
| 4,452,472 | 6/1984 | Crase | 285/319 |
| 5,146,984 | 9/1992 | Pleasants | 166/238 |
| 5,718,291 | 2/1998 | Lorgen et al. | 166/377 |

FOREIGN PATENT DOCUMENTS

| | | | |
|---|---|---|---|
| 0 839 989 A2 | 6/1998 | European Pat. Off. | E21B 17/06 |
| 2 244 736 | 11/1991 | United Kingdom | E21B 43/10 |
| WO 98/13576 | 2/1998 | WIPO | E21B 31/00 |

*Primary Examiner*—Dave W. Arola
*Attorney, Agent, or Firm*—Robert A. Kent; Neal R. Kennedy

[57] ABSTRACT

A coiled tubing drilling hydraulic disconnect for use in disconnecting a tool from a length of tubing or other tool string. The apparatus has an upper housing and a lower housing with a splined ring threadingly engaged with the lower housing. A spline in the splined ring engages a spline on the upper housing so that torque may be transmitted therebetween. Lugs are disposed through windows in the lower housing below the splines, and a bushing is disposed between the splined ring and the lugs. Relative rotation between the upper and lower housings causes the splined ring to tighten against the bushing and lugs, thereby eliminating play therebetween. A lug prop disposed in the upper housing may be hydraulically actuated so that the lugs may move to a disconnect position, thereby releasing the upper housing from the lower housing. Because the windows are disposed below the splines, no torque or bending are applied to the windows, and the windows and lugs are shaped to minimize stress concentrations.

34 Claims, 4 Drawing Sheets

COILED TUBING DRILLING HYDRAULIC DISCONNECT

BACKGROUND OF THE INVENTION

1. Field of the Invention

This invention relates to apparatus for disconnecting coiled tubing from a tool in a well, and more particularly, to a hydraulic disconnect with reduced stress concentrations and bending moment applied to the components thereof.

2. Description of the Prior Art

In the operation of oil and gas wells, it is often necessary to perform several downhole operations in the well. Thus, various types of operating tools have evolved to perform these various operations. Previously, wireline was often used to connect the operating tools to equipment above ground and to lower, set and retrieve the operating tools into and from the well.

More recently, coiled tubing has been used in certain applications which has several advantages. For example, coiled tubing does not rely on gravity for setting and retrieving operating tools, but can rather be used to traverse highly deviated, or horizontal, wells. Also, coiled tubing can be inserted more rapidly into the well than jointed tubing and more easily passed through downhole equipment. Coiled tubing can also be used to convey fluids to the operating tool to hydraulically actuate the tool. Further, fluids such as water, foam, paraffin, corrosion inhibitors, spotting acid, cement, and the like, can be conveyed by the coiled tubing to the well for performing various functions including washing, cleaning and the like.

It is not an uncommon occurrence for the operator to wish to leave a tool in the well or for a tool to become stuck or jammed in the well. In either case, it is necessary to disconnect the coiled tubing from the tool so that the coiled tubing can be removed from the well. The operating equipment is subsequently fished out of the well. To accommodate this, disconnect or emergency release devices have been developed. Such disconnects are installed near the end of the tubing adjacent to the tool at the lower end of the tubing. One such device is shown in U.S. Pat. No. 5,146,984, assigned to a related company to the assignee of the present invention. This device releasably connects the tubing to the downhole tool and permits flow of fluid from the tubing to the tool as well. A prop in the disconnect can be hydraulically actuated to release lugs to disconnect the upper portion of the disconnect from the lower portion and thereby release the coiled tubing from the downhole tool.

Coiled tubing drilling operations put severe stress cycles on the bottom hole assembly in a very short time. With downhole motors that rotate from 180 to 1,000 rpm, thus applying torque to the tubing, the stress cycles required to induce failure in a tool can be short as a few hours. One of the most failure-prone components in a drilling bottom-hole assembly is the hydraulic disconnect.

Many hydraulic disconnects, such as the prior art device described above, use a set of rectangular lugs that rest on an internal shoulder in the bottom sub of the disconnect as a means of supporting tensile load. The lugs are disposed in rectangular-shaped windows which are usually machined radially into the side of the upper sub of the disconnect. The shape of these windows tends to present a problem because of the stress risers of the corner of the windows.

Another problem with many hydraulic disconnects is the location of the windows. When the motor in the bottom hole assembly is rotated, the hydraulic disconnect transmits torque to the tubing so that the drill bit will rotate with respect to the stationary tubing. During drilling, the bottom hole assembly torques up so that the drill bit will start to cut. When the drill actually cuts, the torque is momentarily released. The process is repeated over and over during drilling. Because the cutting operation is not even, these continuous cycles of cutting and releasing result in corresponding cycles of the application of torque followed by the release of the torque.

The torque is transmitted through the hydraulic disconnect at a torque transmission area. The windows in which the lugs in the hydraulic disconnect are disposed are frequently located above the torque transmission area. Thus, torque is applied at the windows which increases the possibility of failure.

When the bottom hole assembly is torqued, there is enough flexibility in the tubing that the top of the disconnect attached to the end of the tubing is pushed toward the side of the well as a result of bending in the tubing. Thus, a bending moment is applied to the hydraulic disconnect. This cyclic bending varies with the torque cycling. The location of the windows above the torque transmission area results in this bending force being applied across the windows.

The torquing and bending results in stress cycling across the window which can result in a fatique cracking problem. The present invention solves this problem by locating the windows below the torque transmission area. Thus, no torque and no bending moment and associated cyclic stresses are applied to the windows.

A further problem with existing hydraulic disconnect design relates to the method of transmitting torque in the tool. Some disconnects, such as that described in U.S. Pat. No. 5,146,984 described above, used interconnected splines which are machined in the top and bottom subs. Other designs use machined fingers that fit in matching notches. Other similar designs exist, but generally these present problems with fretting or fatigue cracking due to the reverse stress cycling that is inherent to drilling bottom hole assemblies.

The present invention solves these problems by using a different approach to transmitting torque. The present invention uses an internal thread in a lower housing portion of the disconnect that is threadingly engaged with a splined ring which is held onto an upper housing portion by a bushing and specially designed lugs. The lugs are shaped in a manner to reduce stress concentrations around lug windows in the upper housing portion. As previously mentioned, the lug windows are located near the lower end of the upper housing portion below the torque transmission area, thereby eliminating torque loading and the bending moment across the windows. This results in a reduction in fatigue problems.

The threading engagement of the splined ring allows the splined ring to tighten the bushing against the lugs. Thus, any slack or looseness between the parts is eliminated, and fretting and other wear problems are minimized because the parts do not chatter against one another while drilling. Of course, this increases the tool life.

SUMMARY OF THE INVENTION

The coiled tubing drilling hydraulic disconnect of the present invention may be generally described as an apparatus for disconnecting a lower tubing or tool string portion, such as a downhole tool, from an upper tubing or tool string portion, such as a length of coiled tubing. The apparatus comprises a first housing member connectable to one of the tool and tubing and defining a housing threaded surface therein, a second housing member connectable to the other of the tool and tubing and having a portion positionable in the first housing member and defining a housing splined surface thereon, a splined ring defining a ring threaded surface thereon threadingly engaged with the housing threaded surface and a ring splined surface engaged with the housing splined surface such that relative rotation between the second housing member and the splined ring is prevented, locking means for locking the second housing member to the first housing member and the splined ring and thereby preventing relative longitudinal movement between the first and second housing members, and disconnecting means for disengaging the locking means and thereby disconnecting the second housing member from the first housing member.

In the preferred embodiment, the second housing member defines a transversely extending window therein. The locking means comprises a bushing disposed adjacent to the splined ring and defining an annular groove therein, a lug disposed in the window and extending into the groove, and a lug prop disposed in the second housing member and having a first outer surface engaged with the lug such that radial movement of the lug and disengagement of the lug with the groove is prevented. The disconnecting means comprises a second outer surface on the prop smaller than the first outer surface and alignable with the lug when the prop is moved longitudinally with respect to the second housing member such that the lug is movable radially inwardly toward the second outer surface and thereby disengaged from the groove. The groove has a cross-sectionally curved surface, and the lug has a cross-sectionally curved surface corresponding to the curved surface of the groove. Preferably, the window in the second housing member is one of a plurality of windows, and the lug is one of a plurality of lugs disposed in corresponding windows.

The second housing member has a shoulder thereon, and the first housing member has an end engaged with this shoulder. During assembly, the first and second housing members are rotated with respect to one another, and the threaded engagement between the splined ring and the second housing member will cause the first and second housing members to move longitudinally toward one another until the upper end of the first housing member is engaged with the shoulder on the second housing member, thus preventing any further relative longitudinal movement between the first and second housing members toward one another when there is relative rotation therebetween. After the first and second housing members have shouldered up in this way, the splined ring moves longitudinally in the first housing member in response to further relative rotation between the first and second housing members such that the splined ring forces the bushing into clamping engagement with the lug, thereby eliminating all play and looseness between the parts.

In an illustrated embodiment, the first housing member comprises a first sub defining the housing threaded surface therein and a second sub which is threadingly engaged with a portion of the housing threaded surface.

More specifically, the present invention may be described as a disconnect for use in a well comprising an upper housing connectable to an upper tool string portion. The upper housing has a splined surface thereon, a window defined therein and a central opening defined therethrough. The apparatus further comprises a splined ring slidably disposed on the upper housing and having a splined surface therein engaged with the splined surface on the upper housing, a bushing disposed adjacent to an end of the splined ring and having a groove defined therein, a lower housing connectable to a lower tool string portion and rotatably connected to the splined ring, a lug disposed in the window wherein the lug extends into the groove when in a lug locking position and is disengaged from the groove when in a lug disconnect position, and a lug prop slidably disposed in the upper housing and having a prop locking position wherein a first outer surface of the prop holds the lug in the lug locking position and a prop disconnect position wherein a second outer surface of the prop allows the lug to be moved to the lug disconnect position. Preferably, the lower housing is threadingly engaged with the splined ring such that relative rotation between the upper and lower housings moves the splined ring in a longitudinal direction against the bushing, whereby the bushing is clampingly engaged with the lug. A shear means may be provided for shearably holding the prop in the prop locking position.

In an alternate embodiment, the splined ring and bushing may be formed as a single piece.

In the preferred embodiment, the windows in the upper housing, along with the lugs disposed therein, are spaced from the splined surfaces such that any torque and bending transmitted therebetween is not applied to the windows or lugs. This is preferably accomplished by positioning the window and lugs near a lower end of the upper housing below the splined surfaces.

Numerous objects and advantages of the invention will become apparent from the following description of the preferred embodiment and the drawings illustrating such embodiment.

DESCRIPTION OF THE PREFERRED EMBODIMENT

Figure 1:
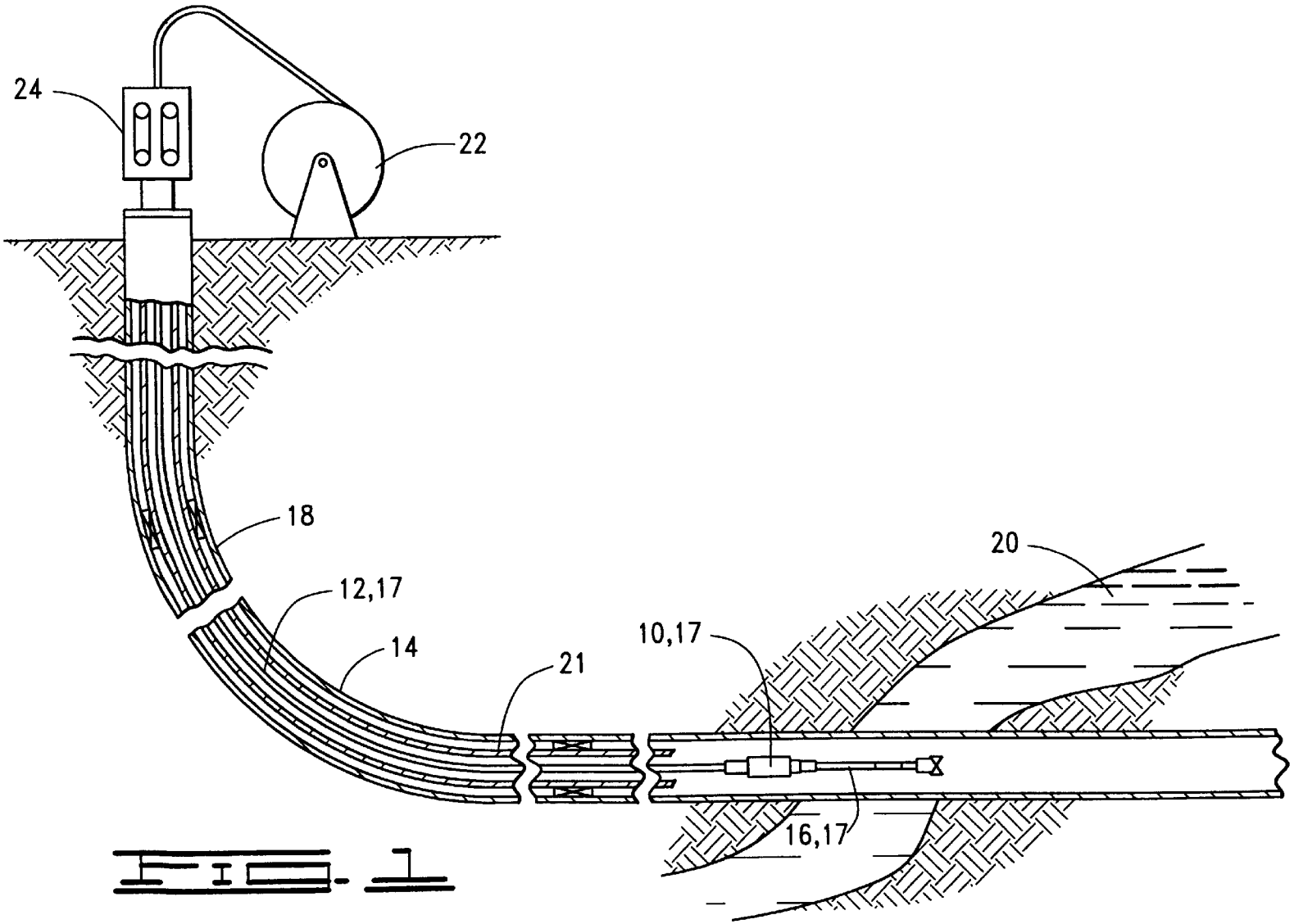
FIG. 1 is a schematic showing the coiled tubing drilling hydraulic disconnect of the present invention positioned in a coiled tubing string in a deviated well.

Referring now to the drawings, and more particularly to FIG. 1, the coiled tubing drilling hydraulic disconnect of the present invention is shown and generally designated by the numeral 10. Apparatus 10 is shown at the lower end of a length of coiled tubing 12 disposed in a well 14. Connected below disconnect apparatus 10 is an operating tool, such as a bottom hole assembly 16. Coiled tubing 12, disconnect apparatus 10 and bottom hole assembly 16 all form a tool or tubing string 17 with the coiled tubing forming an upper portion thereof and the bottom hole assembly forming a lower portion thereof. Tubing string 17 is shown positioned in a well casing 18 intersecting a downhole formation or zone of interest 20. A string of production tubing 21 may be located within casing 18, in which case, tubing string 17 disposed through the well tubing.

Tubing 12 is stored on a reel 22 at the surface and is run into casing 18 and well 14 by a tubing injector 24 of a kind known in the art. Other conventional components of the well at the surface are omitted for clarity.

Referring now to FIGS. 2A, 2B and 4–7, the details of disconnect apparatus 10 will be described. Apparatus 10 has an outer housing 30 comprising a first housing member 32 and a second housing member 34. Housing 30 defines a central opening 36 therethrough.

In the illustrated embodiment, second housing member 34 is an upper housing and may also be referred to as top sub 34. Top sub 34 defines an internal thread 38 in an upper end thereof which is adapted for connection to tubing string 12.

First housing member 32 is a lower housing and in the preferred embodiment comprises a bottom sub 40 and a central sub 42 connected to the bottom sub at threaded connection 44.

Bottom sub 40 has an external thread 46 thereon adapted for connection to bottom hole assembly 16 or other downhole tool.

Top sub 34 has a first outside diameter 48 and a smaller second outside diameter 50. A downwardly facing shoulder 52 extends radially outwardly from the upper end of first outside diameter 48 on top sub 34.

The upper end of central sub 42 is a fishing neck 54 having a bore 56 therein with a small annular shoulder 58 extending radially outwardly therefrom. Bore 56 is adapted for close sliding engagement with first outside diameter 48 of top sub 34. A sealing means, such as a pair of O-rings 60, provide sealing engagement between fishing neck 54 and first outside diameter 48 of top sub 34.

Central sub 42 defines an internal housing threaded surface 62 therein which may form a part of threaded connection 44, although the invention is not intended to be so limited. A splined ring 64 is annularly disposed between central sub 42 and top sub 34 and has an external ring threaded surface 66 thereon which is threadingly engaged with housing threaded surface 62 in central sub 42.

Top sub 34 has a male housing splined surface 68, also called male spline 68, thereon which is longitudinally disposed between first outside diameter 48 and second outside diameter 50. Splined ring 64 has a female ring splined surface 70, also called female spline 70, therein which is adapted for mating engagement with male spline 68 on top sub 34.

Top sub 34 defines a first bore 72 and a slightly smaller second bore 74 therein. An upwardly facing shoulder 75 extends between first bore 72 and second bore 74.

A lug prop 76 is slidably disposed in central opening 36 of housing 30 and has a first outside diameter 78 adapted for close sliding engagement within first bore 72 of top sub 34 and a slightly smaller second outside diameter 80 adapted for close sliding engagement within second bore 74 of the top sub. A downwardly facing shoulder 81 extends between first outside diameter 78 and second outside diameter 80.

An annular relief 82 is thus defined between shoulders 75 and 81. Prop 76 defines a transversely extending port 84 which provides communication between relief 82 and central opening 36 of housing 30.

A shearing means, such as a shear pin 86, is attached to top sub 34 and extends radially inwardly into a groove 88 defined in first outside diameter 78 of prop 76. Thus, prop 76 is shearably held in the running configuration shown in FIGS. 2A and 2B.

A sealing means, such as a pair of O-rings 90 and 92, provide sealing engagement between first outside diameter 78 of prop 76 and first bore 72 of top sub 34 on opposite sides of shear pin 86.

Figure 2A:
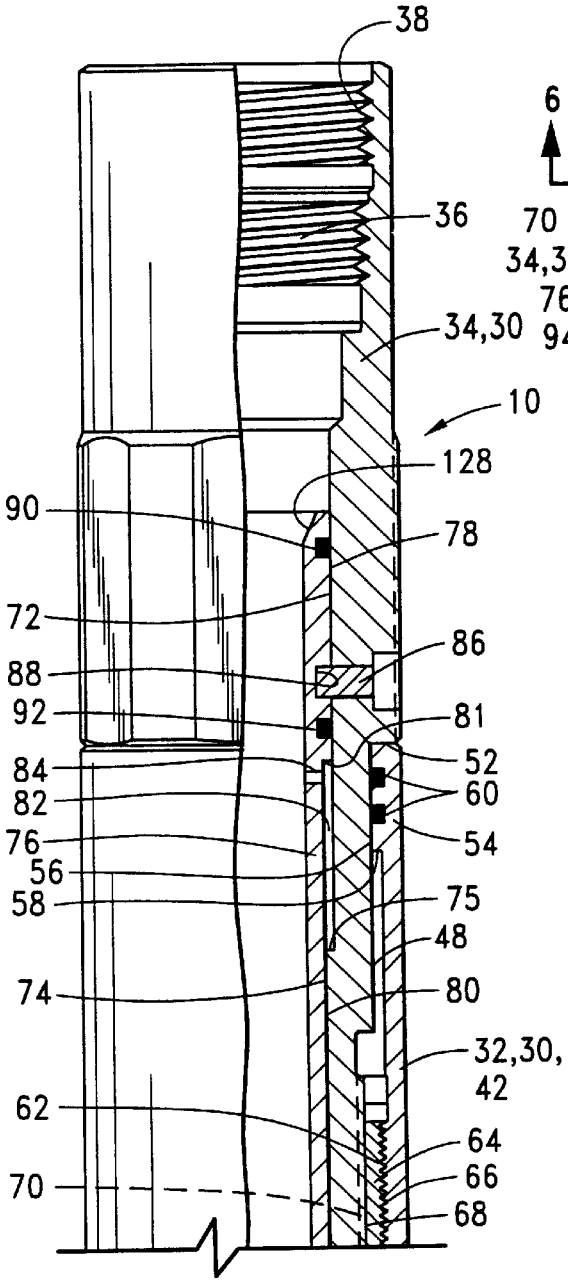
FIGS. 2A and 2B show a partial cross section of the hydraulic disconnect shown in its running configuration.
Figure 2B:
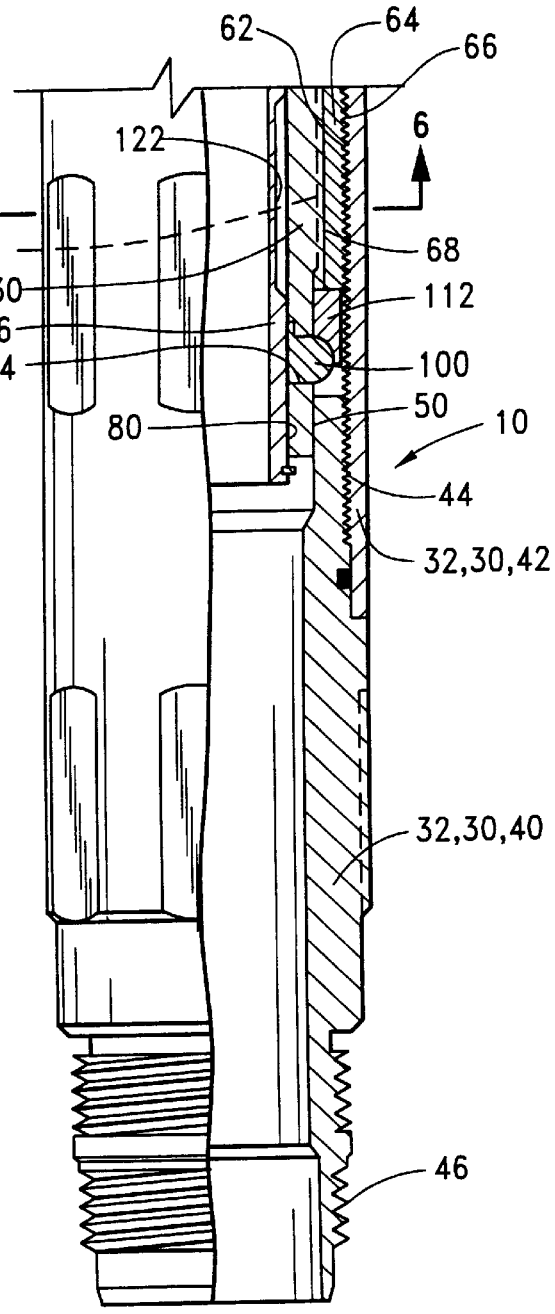
Figure 4:
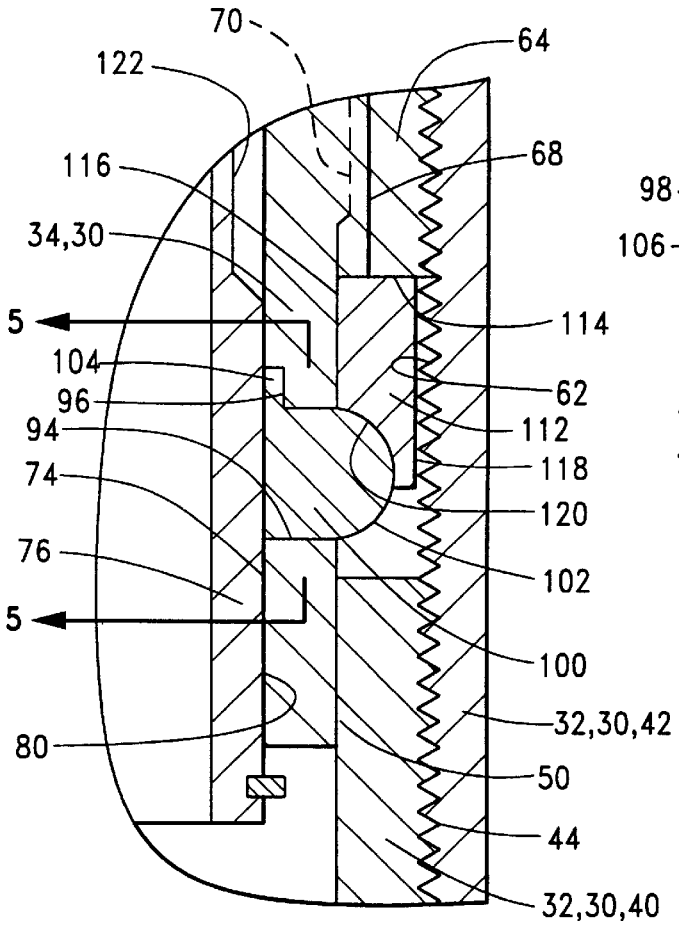
FIG. 4 is an enlarged detail showing lugs engaged with a bushing.
Figure 5:
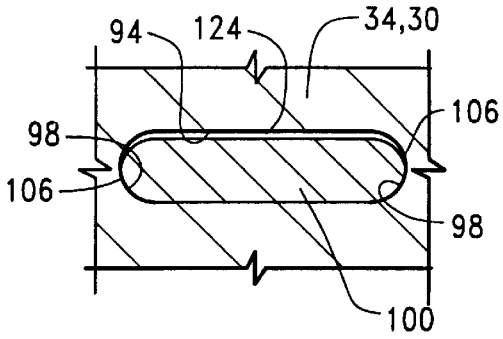
FIG. 5 is a cross section taken along lines 5—5 in FIG. 4.
Figure 6:
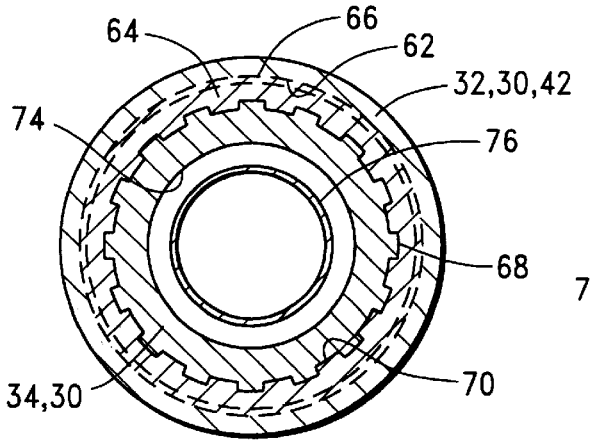
FIG. 6 shows a cross section taken along lines 6—6 in FIG. 2.
Figure 7:
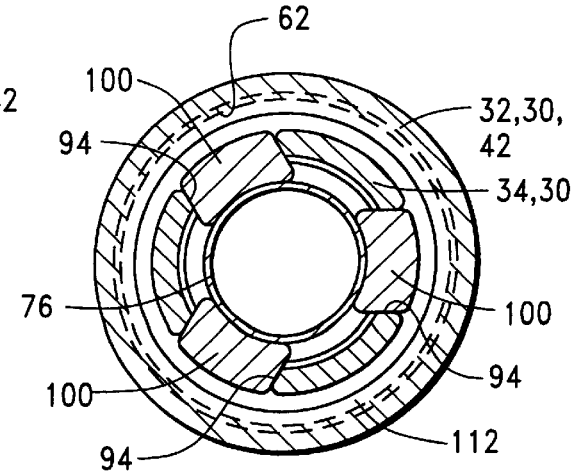
FIG. 7 shows a cross section taken along lines 7—7 in FIG. 3.

Referring to FIGS. 2B, 4 and 5, top sub 34 defines a plurality of circumferentially spaced windows 94 radially therethrough. Each window 94 has a undercut 96 at an upper, inside edge thereof adjacent to second bore 74 in top sub 34, as best seen in FIG. 4. Looking at FIG. 5, each window 94 is generally elongated with substantially fully radiused opposite ends 98.

A retaining lug 100 is disposed in each window 94 and has a curved radially outer surface 102 which extends radially outwardly from the corresponding window. A small foot 104 extends upwardly from the inside of each lug 100 and is adapted to fit in a corresponding undercut 96 of a window 94. Thus, it will be seen that lugs 100 cannot escape radially outwardly from windows 94, and the maximum radially outward position of each lug 100 is that shown in FIGS. 2B and 4. In the running position shown in FIGS. 2A, 2B and 4, lugs 100 are held in windows 94 by second outside diameter 80 of prop 76.

Referring to FIG. 5, each lug 100 has a curved end 106 adapted to generally conform with curve ends 98 in windows 94. Thus, it will be seen by those skilled in the art that stress concentrations are greatly reduced between lugs 100 and windows 94 as compared to prior art lugs with substantially square corners.

Referring again to FIGS. 2B and 4, a bushing 112 is disposed between lugs 100 and lower end 114 of splined ring 64. Bushing 112 is disposed longitudinally below splined surfaces 68 and 70 and has a bore 116 therethrough sized to fit around second outside diameter 50 of top sub 34 and allow relative rotation therebetween. Bushing 112 has an outside diameter 118 which is slightly smaller than internal thread 62 in central sub 42. The lower end of bushing 112 has an annular groove 120 having a curvilinear cross section corresponding to the curvature of outer surface 102 of lugs 100. In the illustrated embodiment, groove 120 contacts approximately the upwardly facing half of curved outer surface 102 of lugs 100.

In an alternate embodiment, splined ring 64 and bushing 112 may be integrally formed as a single piece with groove 120 at the lower end thereof.

A recessed surface or groove 122 is formed in second outside diameter 80 of prop 76. In the running position shown in FIG. 2B, groove 122 is spaced above lugs 100.

OPERATION OF THE INVENTION

For running into well 14 on tubing string 17, apparatus 10 is assembled in the configuration shown in FIGS. 2A and 2B as previously described. Because of the splined engagement between male spline 68 on top sub 34 and female spline 70 in splined ring 64, it will be seen that relative rotation therebetween is prevented and torque may be transmitted. Initially, relative rotation between top sub 34 and lower housing portion 32 will result in the top sub and lower housing portion being moved longitudinally toward one another until the upper end of fishing neck 54 engages shoulder 52 on the top sub. At this point where fishing neck 54 shoulders against shoulder 52, any further longitudinal movement between top sub 34 and lower housing portion 32 is prevented. However, further relative rotation between top sub 34 and lower housing portion 32 results in the same relative rotation between splined ring 64 and central sub 42. Because of the threaded engagement between ring threaded surface 66 on splined ring 64 and housing threaded surface 62 in central sub 42, this further relative rotation between the splined ring and the central sub will result in longitudinal movement of the splined ring with respect to lower housing portion 32. Therefore, by providing relative rotation in a right-hand direction, splined ring 64 will be moved downwardly within central sub 42 after fishing neck 54 engages shoulder 52 so that it bears against bushing 112 and forces bushing 112 into clamping engagement with lugs 100. This pushes lugs 100 downwardly until they are clamped against a lower side of the corresponding windows 94. Because of tolerances, a slight gap 124 is therefore formed between the upper side of each window 94 and the top side of the corresponding lug 100, as shown in FIG. 5. Gap 124 is very small and is not shown in any of the other figures. In this way, any looseness or play of lugs 100 and bushing 112 is eliminated and any chattering of the lugs in the windows or against bushing 112 is eliminated. This reduces the possibility of fretting and fatigue failures associated with prior art disconnect devices which do not have this clamping feature.

In the running configuration shown in FIGS. 2A and 2B, once fishing neck 54 has shouldered against shoulder 52 and splined ring 64 has clamped bushing 112 against lugs 100, it will be seen that torque may be transmitted between lower housing portion 32 and top sub 34 through splined ring 64 and the engagement of splines 68 and 70. When bottom hole assembly 16 is actuated to rotate the motor which drives the drill bit, torque is applied to the bottom hole assembly and disconnect apparatus 10. This torque is transmitted through disconnect apparatus 10 to tubing string 12 as previously described. However, because windows 94 are formed in top sub 34 below splines 68 and 70, no torque or bending moment are applied to the windows which greatly reduces the stresses thereon. That is, the location of windows 94 near the lower end of top sub 34 provides a great improvement over the prior art in which windows were positioned above the splines which resulted in torsional and bending stresses being applied to the windows.

Figure 3A:
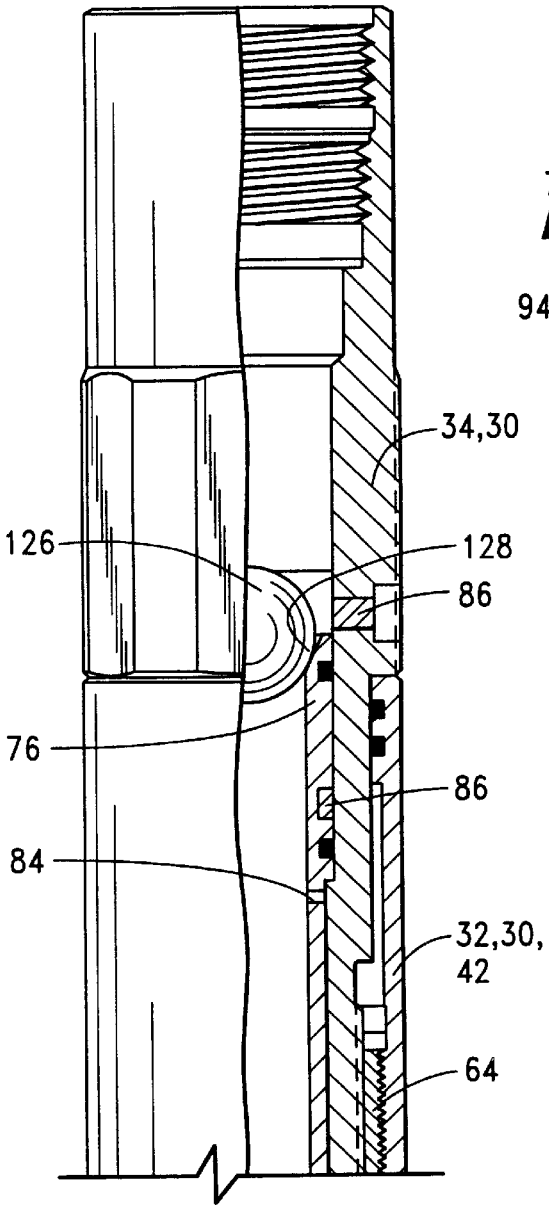
FIGS. 3A and 3B show a partial cross section of the hydraulic disconnect shown in its releasing configuration.
Figure 3B:
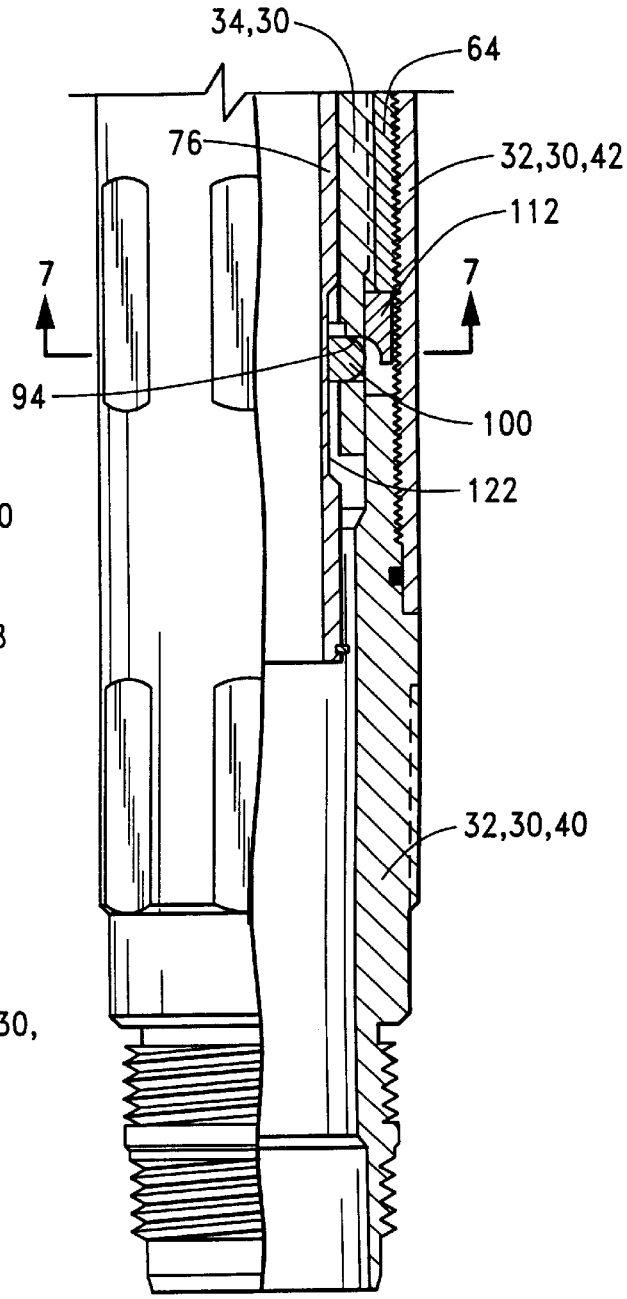

If bottom hole assembly 16 becomes stuck, or if it is desired to release it or another tool in well 14, disconnect apparatus 10 may be actuated to release coiled tubing 12. A ball 126 is dropped down tubing string 12 so that it engages a chamfered internal seat 128 in the upper end of prop 76. Hydraulic pressure is applied in tubing string 12 so that ball 126 and prop 76 are forced downwardly within top sub 34, shearing shear pins 86. See FIGS. 3A and 3B. Prop 76 moves downwardly until shoulder 81 on prop 76 engages shoulder 75 in top sub 34, thus eliminating relief 82. Port 84 insures that no liquid can be trapped in relief 82.

At this point, groove 122 in prop 76 is generally aligned with windows 94 in top sub 34 and therefore also generally aligned with lugs 100. It will be seen that lugs 100 are now free to be moved radially inwardly until they engage the recessed surface of groove 122. This is accomplished by pulling on tubing string 12 which forces top sub 34 and lugs 100 upwardly. Because of the curved surface engagement between outer surface 102 of lugs 100 and groove 120 in bushing 112, this upward pull will force lugs 100 radially inwardly until they clear bore 116 in bushing 112 which also means that they will clear female spline 70 in splined ring 64. Thus, coiled tubing 12 with top sub 34 attached thereto, along with prop 76, lugs 100 and ball 126 may be removed from well 14 leaving bottom hole assembly 16 therein along with bottom sub 40, central sub 42, splined ring 64 and bushing 112.

These remaining components may be later retrieved from well 14 by use of a conventional fishing tool which engages fishing neck 54 at the upper end of central sub 42.

It will be seen, therefore, that the coiled tubing drilling hydraulic disconnect of the present invention is well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. An apparatus for disconnecting a tool from a tubing string in a well, comprising:

a first housing member connectable to one of the tool and tubing and defining a housing threaded surface therein;

a second housing member connectable to the other of the tool and tubing and having a portion positionable in said first housing member and defining a housing splined surface thereon;

a splined ring defining a ring threaded surface thereon threadingly engaged with said housing threaded surface and a ring splined surface engaged with said housing splined surface such that relative rotation between said second housing member and said splined ring is prevented;

locking means for locking said second housing member to said first housing member and said splined ring and thereby preventing relative longitudinal movement between said first and second housing members; and disconnecting means for disengaging said locking means and thereby disconnecting said second housing member from said first housing member.

2. The apparatus of claim 1 wherein:

said second housing member defines a transversely extending window therein; and said locking means comprises:

a bushing disposed adjacent to said splined ring and defining an annular groove therein;

a lug disposed in said window and extending into said groove; and a lug prop disposed in said second housing member and having a first outer surface engaged with said lug such that radial movement of said lug and disengagement of said lug with said groove is prevented.

3. The apparatus of claim 2 wherein said disconnecting means comprises:

a second outer surface on said prop smaller than said first outer surface and alignable with said lug when said prop is moved longitudinally with respect to said second housing member such that said lug is movable radially inwardly toward said second outer surface and thereby disengaged from said groove.

4. The apparatus of claim 2 wherein:

said groove has a cross-sectionally curved surface; and said lug has a cross-sectionally curved surface corresponding to said curved surface of said groove.

5. The apparatus of claim 2 wherein:

said second housing member has a shoulder thereon;

said first housing member has an end engaged with said shoulder, thereby preventing relative longitudinal movement between said first and second housing members toward one another when there is relative rotation between said first and second housing members; and said splined ring moves longitudinally in said first housing member in response to relative rotation between said first and second housing members such that said splined ring forces said bushing into clamping engagement with said lug.

6. The apparatus of claim 2 wherein said lug is one of a plurality of lugs circumferentially spaced around said second housing portion.

7. The apparatus of claim 2 wherein said window is spaced from said housing splined surface and said ring splined surface such that torque transmitted between said splined surfaces is not applied to said window.

8. The apparatus of claim 1 wherein said first housing member comprises:

a first sub defining said housing threaded surface therein; and a second sub threadingly engaging a portion of said housing threaded surface.

9. The apparatus of claim 1 further comprising sealing means for sealing between said first and second housing members.

10. The apparatus of claim 1 wherein said first housing member comprises a fishing neck.

11. A disconnect apparatus for use in a well, comprising:

an upper housing connectable to an upper tool string portion, said upper housing having:
a splined surface thereon;
a window defined therein; and
a central opening defined therethrough;

a splined ring slidably disposed on said upper housing and having a splined surface therein engaged with said splined surface on said upper housing, said splined ring having an end thereon;

a lower housing connectable to a lower tool string portion, said lower housing being rotatable connected to said splined ring such that relative rotation between said lower housing and said splined ring longitudinally moves said splined ring with respect to said upper housing;

a bushing disposed adjacent to an end of said splined ring and having a groove defined therein;

a lug disposed in said window, said lug extending into said groove when in a lug locking position in which said bushing is clamped against said end of said splined ring and disengaged from said groove when in a lug disconnect position; and a lug prop slidably disposed in said upper housing and having a prop locking position wherein a first outer surface of said prop holds said lug in said lug locking position and a prop disconnect position wherein a second outer surface of said prop allows said lug to be moved to said lug disconnect position.

12. The apparatus of claim 11 wherein:

said groove has a curved annular inner surface; and said lug has a curved annular outer surface corresponding to said annular inner surface.

13. The apparatus of claim 12 wherein engagement between said annular inner and outer surfaces moves said lug to said lug disconnect position when said prop is in said prop disconnect position in response to relative longitudinal movement of said upper and lower housings away from one another.

14. The apparatus of claim 11 wherein:

said upper housing has a shoulder thereon for engaging an end of said lower housing and thereby limiting relative longitudinal movement of said upper and lower housings toward one another.

15. The apparatus of claim 11 wherein said prop has a seat thereon adapted for receiving a ball for hydraulic actuation of said prop to said prop disconnect position.

16. The apparatus of claim 11 further comprising shear means for shearably holding said prop in said prop locking position.

17. The apparatus of claim 11 further comprising sealing means between said upper housing and said prop.

18. The apparatus of claim 11 wherein said window is adjacent to a lower end of said upper housing and spaced from said splined surfaces on said splined ring and said upper housing such that torque transmitted between said splined surfaces due to rotation of said lower housing is not applied to said window.

19. The apparatus of claim 11 wherein:

said window is one of a plurality of windows spaced around said upper housing; and said lug is one of a plurality of lugs, each lug being disposed in a corresponding window.

20. A disconnect apparatus for use in a well, comprising:

an upper housing connectable to an upper tool string portion, said upper housing having:
a splined surface thereon;
a window defined therein; and
a central opening defined therethrough;

a splined ring slidably disposed on said upper housing and having a splined surface therein engaged with said splined surface on said upper housing;

a bushing disposed adjacent to an end of said splined ring and having a groove defined therein;

a lug disposed in said window, said lug extending into said groove when in a lug locking position and disengaged from said groove when in a lug disconnect position;

a lower housing connectable to a lower tool string portion and rotatably connected to said splined ring, said lower housing being threadingly engaged with said splined ring such that relative rotation between said upper and lower housings moves said splined ring in a longitudinal direction against said bushing whereby said bushing is clampingly engaged with said lug, thereby clamping said lug against the side of said window and eliminating looseness between said lug and said window; and a lug prop slidably disposed in said upper housing and having a prop locking position wherein a first outer surface of said prop holds said lug in said lug locking position and a prop disconnect position wherein a second outer surface of said prop allows said lug to be moved to said lug disconnect position.

21. The apparatus of claim 20 wherein:

said lower housing comprises:
a bottom sub; and
a central sub threadingly engaged with said bottom sub; and said splined ring is threadingly engaged with said central sub.

22. The apparatus of claim 21 wherein said central sub comprises a fishing neck.

23. The apparatus of claim 21 further comprising sealing means for sealing between said upper housing and said central sub.

24. A disconnect apparatus for use in a well, comprising:

an upper housing connectable to an upper tool string portion, said upper housing having:
a splined surface thereon;
a window defined therein; and
a central opening defined therethrough;

a splined ring slidably disposed on said upper housing and having a splined surface therein engaged with said splined surface on said upper housing;

a bushing disposed adjacent to said splined ring and defining a groove therein;

a lug disposed in said window, said lug extending into said groove when in a lug locking position and disengaged from said groove when in a lug disconnect position; and a lower housing connectable to a lower tool string portion and threadingly engaged with said splined ring such that relative rotation between said upper and lower housings longitudinally moves said splined ring against said bushing, thereby moving said bushing into clamping engagement with said lug.

25. The apparatus of claim 24 wherein:

said groove has a curved annular inner surface; and said lug has a curved annular outer surface corresponding to said annular inner surface.

26. The apparatus of claim 25 wherein engagement between said annular inner and outer surfaces moves said lug from said lug locking position to said lug disconnect position in response to relative longitudinal movement of said upper and lower housings away from one another.

27. The apparatus of claim 24 further comprising a lug prop slidably disposed in said upper housing and having a prop locking position wherein a first outer surface of said prop holds said lug in said lug locking position and a prop disconnect position wherein a second outer surface of said prop allows said lug to be moved to said lug disconnect position.

28. The apparatus of claim 27 wherein said prop has a seat thereon adapted for receiving a ball for hydraulic actuation of said prop to said prop disconnect position.

29. The apparatus of claim 27 further comprising shear means for shearably holding said prop in said prop locking position.

30. The apparatus of claim 27 further comprising sealing means between said upper housing and said prop.

31. The apparatus of claim 24 wherein:

said lower housing comprises:

a bottom sub; and a central sub threadingly engaged with said bottom sub; and said splined ring is threadingly engaged with said central sub.

32. The apparatus of claim 31 wherein said central sub comprises a fishing neck.

33. The apparatus of claim 24 wherein said window is adjacent to a lower end of said upper housing such that torque transmitted between said splined surfaces on said splined ring and said upper housing is not applied to said window.

34. The apparatus of claim 24 wherein:

said window is one of a plurality of windows spaced around said upper housing; and said lug is one of a plurality of lugs, each lug being disposed in a corresponding window.

* * * * *